United States Patent [19]

Glass

[11] Patent Number: 4,974,815

[45] Date of Patent: Dec. 4, 1990

[54] PLASTIC TRAFFIC BARRICADE

[75] Inventor: Geoffrey M. Glass, Rolling Meadows, Ill.

[73] Assignee: Best Barricade, Rolling Meadows, Ill.

[21] Appl. No.: 486,306

[22] Filed: Feb. 28, 1990

[51] Int. Cl.[5] ..... E04H 17/14

[52] U.S. Cl. ..... 256/64; 256/1; 40/610; 404/6

[58] Field of Search ..... 40/610, 612; 256/64, 256/1; 404/6, 9

[56] References Cited

U.S. PATENT DOCUMENTS 930,509 8/1909 Warfield ..... 40/610

2,583,244 1/1952 Underwood ..... 40/610 X 4,253,260 3/1981 Maza et al. ..... 40/610

4,298,186 11/1981 Glass ..... 256/64

*Primary Examiner*—Andrew V. Kundrat

*Attorney, Agent, or Firm*—Willian Brinks Olds Hofer Gilson & Lione

[57] ABSTRACT

A plastic traffic barricade comprises two integrally molded, generally planar panel units each having two upstanding legs interconnected by a panel member and each having a hinge projection mating with a hinge projection on the other panel unit and a hinge pin extending thru the mated hinge projections and a handle member extending between the mated pair of hinge projections.

11 Claims, 2 Drawing Sheets

PLASTIC TRAFFIC BARRICADE

FIELD OF THE INVENTION

This invention relates to traffic barricades. It relates particularly to molded plastic traffic barricades.

BACKGROUND OF THE INVENTION

Traffic barricades are commonly used to warn vehicle traffic and pedestrians of danger and block off restricted areas. Barricades made of molded plastic have been known for some time. Examples are found in the Stehle et al. U.S. Pat. Nos. 3,880,406 and 3,950,873, and the Glass U.S. Pat. Nos. 4,298,186 and 4,624,210. Barricades illustrated in these patents include two panel units hinged together so that they can be spread apart for use and collapsed for storage or transport. The individual panel units are one piece, integral, hollow plastic panels, formed by rotational or blow molding. The lower hollow sections may contain ballast.

These plastic traffic barricades were a great improvement over conventional steel and wood barricades. They are rugged, yet cause less damage to vehicles if inadvertently struck. Through the use of ballast in the units the center of gravity of the barricade is lower than either wood or metal barricades. The result is a barricade less susceptible to being blown over by wind. Other features typically incorporated in such barricades are bright colored reflective horizontal panels, flashing lights or signs, and a structural member near the bottom where a sand bag can be placed if additional ballast is required.

As previously pointed out, the barricades are collapsed for storage or transport. When transported they are normally handled in collapsed form. However, it is frequently necessary to move them about, on the job, so to speak, while in spread apart form. In either mode, the plastic barricade industry has long needed a simple and inexpensive carrying grip, handle, or device for them.

SUMMARY OF THE INVENTION

An object of the present invention is to provide an improvement in a plastic traffic barricade which permits it to easily be moved about, whether it is in an open position for use or folded flat for storage.

Another object is to provide an improvement embodied in a carrying handle for easy handling of the barricade.

In its preferred embodiment a plastic traffic barricade includes two hollow plastic panel units comprised of three horizontal panel members and two side leg members. The upper end of each leg member has a hinge element or elements formed unitarily therewith. In accord with the present invention, a hinge pin extends through each mated set of hinge elements. Between each mated pair of hinge elements, spaced above the uppermost panel members, a hollow plastic tube encircles the pin or pins. The tube length is such that it abuts, or comes into immediately adjacent relationship with, opposing hinge elements.

In one embodiment of the invention a single pin extends through and between the hinge elements atop each leg member. The pin takes the form of a long bolt, having a head at one end and a short threaded section at the other end. A nut threaded onto the threaded section holds the pin in place and, accordingly, the panel units in hinged relationship. The plastic tube encircling the pin has an internal diameter slightly larger than the external diameter of the pin whereby the tube rotates freely but does not rattle.

In another embodiment, employed principally where the barricade is relatively narrow and the leg members closer together, two completely threaded pins are used, one connecting the hinge elements of each opposed pair of leg members. In this form of the invention the inner, free ends of the pins are threaded into opposite ends of the plastic tube so that it is firmly seated on respective pins, i.e., the thread diameter of the pins is equal to or slightly greater than the internal diameter of the tube so that it threads onto each pin.

BRIEF DESCRIPTION OF THE DRAWINGS

These and other objects and advantages of the present invention will be best understood by reference to the following drawings, in which.

DESCRIPTION OF THE PREFERRED EMBODIMENTS

Figure 1:
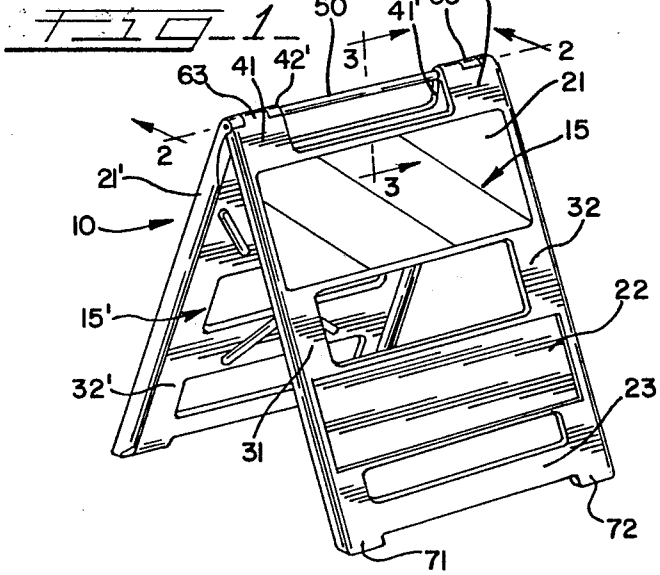
FIG. 1 is a perspective view of one embodiment of the improved barricade.

Referring now to the drawings, FIG. 1 illustrates a plastic traffic barricade 10 incorporating features of one embodiment of the present invention. The barricade 10 is comprised of a pair of identical, integral, hollow plastic panels units 15 and 15'. (throughout the specification, all parts of panel unit 15' are numbered exactly as their counterparts in panel unit 15, with the added prime designation).

Each panel unit 15 and 15' is constructed with three horizontal panel members 21, 21', 22, 22', and 23, 23', two vertical leg members 31, 31' and 32, 32', extended foot portions 71, 71', and 72, 72', and hinge elements 41, 41' and 42, 42'. These components are all parts of the hollow, integral panel units, 15 and 15', molded as unitary structures by conventional blow molding techniques. Panel members 21, 21' and 22, 22' are sometimes referred to as "stripe bars".

The vertical leg members 31, 31' and 32, 32' are approximately thirty nine inches in length and two and one-half inches wide where they are not contiguous with the horizontal panel members or hinge members. The foot members 71, 71' and 72, 72' extend approximately one and one-half inches below the lower horizontal panel members. The foot members allow the barricade to be secured on uneven terrain.

Figure 3:
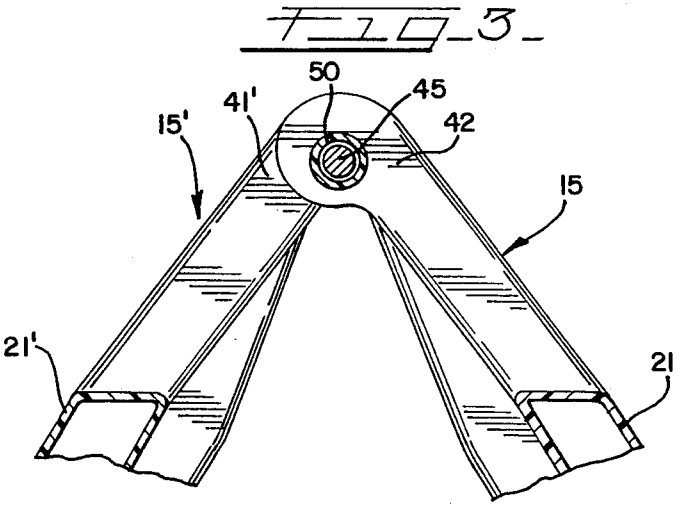
FIG. 3 is an enlarged sectional view taken on line 3—3 of FIG. 1.

The panel units 15 and 15' are normally filled with approximately five pounds of ballast material. The ballast material naturally fills the lower portions of panel units 15 and 15', including foot members, the lower panel members 23 and 23', and the lower portions of leg members. The ballast material 91, which preferably is comprised of sand, is loaded into the panel units 15 and 15' through ports (not shown) in the top of the panel members 21, 23'. After the ballast is loaded the ports are permanently sealed by friction welding a circuit plug into them with conventional friction welding techniques. As can be seen from FIGS. 1 and 3, the hinge element 41 on panel unit 15 mates with the hinge element 42' of the panel unit 15'. In turn the hinge element 42 of the panel unit 10 mates with the hinge element 41' of the panel unit 10'. Each hinge element 41, 41' actually includes a single hinge projection 63, 63' which is about one and three-quarter inches wide. Each hinge element 42, 42' includes double projections 66, 66' and 62, 62' which are about one and one-half inches wide.

Figure 2:
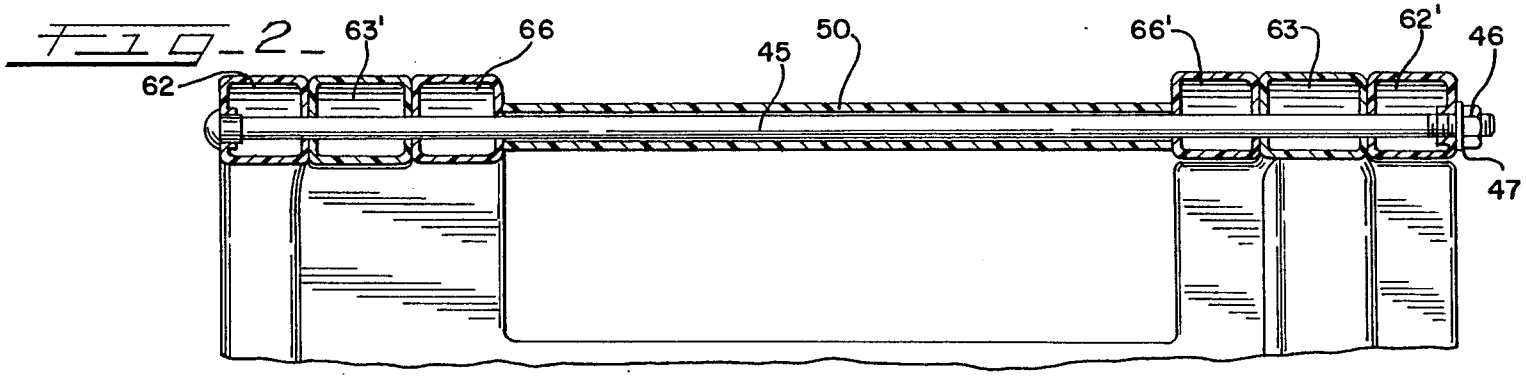
FIG. 2 is an enlarged sectional view taken on line 2—2 of FIG. 1.

Each of the projections 62, 62', 63, 63' and 66, 66' has a transverse, hinge-bolt hole 43, 43' drilled through it. The hinge-bolt holes 43, 43' are approximately three-eighths of an inch in diameter. A single bolt 45 extends through these bolt holes, as best shown in FIG. 2, to pivotly interconnect the hinge element 42 of panel unit 15 with the hinge element 41' of panel unit 10', and the hinge element 41 of panel unit 15 with the hinge element 42' of panel unit 15'. A nut 46 and lock washer 47 inside it secure the bolt 45 in its hinging relationship.

Encircling the bolt 45 between the hinge projections 66 and 66' is a tube 50 of hard plastic, such as polyethylene. The inside diameter of the tube 50 is seven-sixteenths of an inch. The length of the tube 50 is such that it fits closely but loosely between the projections 66 and 66'. The tube 50 wall thickness is substantial, preferably three-sixteenths of an inch. As such, the tube is relatively rigid along its length, which is fifteen inches, the distance between the hinge elements, which are somewhat wider than the leg members 31, 31' and 32, 32'.

Figure 4:
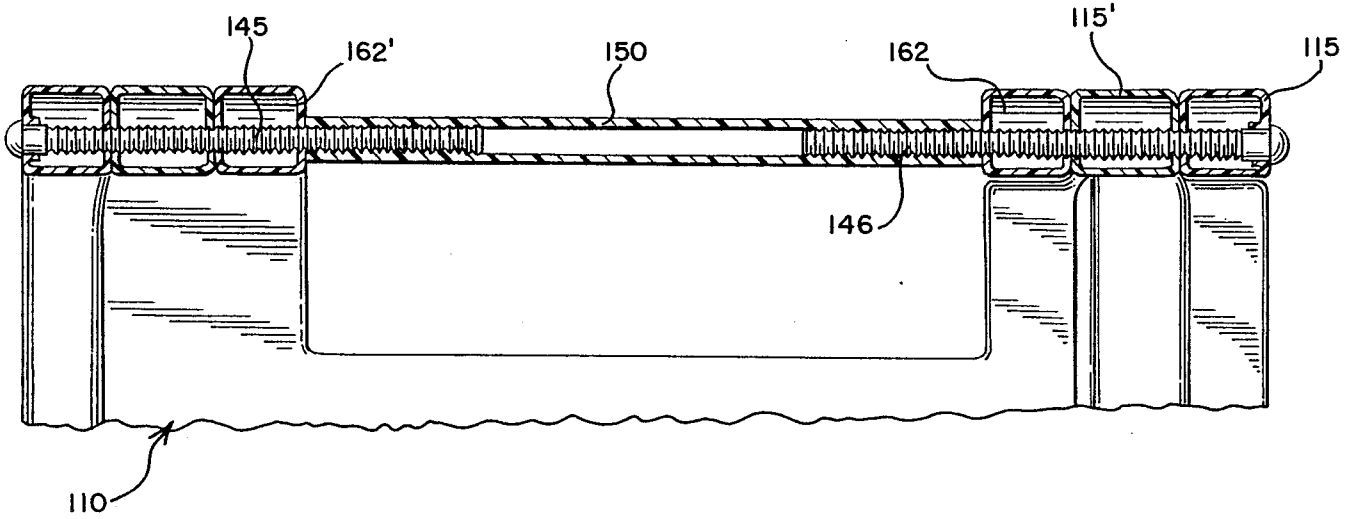
FIG. 4 is an enlarged sectional view similar to FIG. 2 showing another embodiment of the invention.

Referring now to FIG. 4, another embodiment of the barricade is illustrated at 110. The barricade 110 is very similar to the barricade 10 previously described except that it is considerably narrower, i.e., its panel units 115 and 115' are narrower. There overall width is thirteen inches. As a result, the distance between opposed hinge element projections 162, 162' is only six and one-half inches.

In the barricade 110 two bolts 145 and 146 are used as hinge pins, as illustrated. These bolts 145 and 146 are externally threaded along their lengths which is about five inches, and have external pitch diameters of seven-sixteenths of an inch.

The plastic tube 150, which encircles the inner end of each bolt 145 and 146 is actually threaded lengthwise onto each bolt. These bolts 145 and 146 are forced through corresponding hinge projection holes to hinge the panel units 115 and 115' together. The lengths of the bolts 145 and 146 are such that the tube 150 is not supported by them along the middle three to five inches of its length. Because the tube wall thickness is substantial, three-sixteenths of an inch in the present illustration, as has been pointed out, the tube 150 readily supports the barricade 110 when used as a handle. In this regard, the bolts 145 and 146 are preferably about five inches long.

While the preferred embodiment of the invention has been disclosed, it is understood that the invention is not limited to the disclosed example. Modifications in addition to those discussed can be made without departing from the invention. The scope of the invention is indicated in the appended claims, and all changes that come within the meaning and range of equivalency of the claims are therefore intended to be embraced therein.

I claim:

1. In a plastic traffic barricade comprising two integrally molded, generally planar panel units, each of said panel units having two upstanding legs interconnected by at least one panel member, the upper end of each of said legs in each panel unit having at least one hinge projection thereon which mates with a corresponding hinge projection on the upper end of the opposite leg in the other panel unit to form a mated pair of hinge projections, the improvement comprising:

(a) a hinge pin extending through the mated pair of hinge projections for each pair of legs; and (b) a handle member extending between each mated pair of hinge projections;

(c) at least one hinge pin extending into and connecting said handle member to the barricade so that said handle can be used to carry the barricade.

2. The improvement in a plastic traffic barricade of claim 1 further characterized in that:

(a) the hinge pin extending through each mated pair of hinge projections is the same pin.

3. The improvement in a plastic traffic barricade of claim 2 further characterized in that:

(a) said handle member comprises a hollow tube through which said hinge pin extends.

4. The improvement in a plastic traffic barricade of claim 3 further characterized in that:

(a) said hollow tube is a plastic tube having an inside diameter slightly greater than the outside diameter of said pin.

5. The improvement in a plastic traffic barricade of claim 4 further characterized in that:

(a) the inside diameter of said plastic tube is approximately one-sixteenth inch larger than the outside diameter of said pin.

6. The improvement in a plastic traffic barricade of claim 4 further characterized in that:

(a) the thickness of the plastic tube wall is at least one-eighth of an inch.

7. The improvement in a plastic traffic barricade of claim 1 further characterized in that:

(a) the hinge pin extending through each mated pair of hinge projections is a separate hinge pin.

8. The improvement in a plastic traffic barricade of claim 7 further characterized in that:

(a) said handle comprises a plastic tube which is supported at each of its opposite ends by one of said hinge pins.

9. The improvement in a plastic traffic barricade of claim 8 further characterized in that:

(a) each of said pins having external threads formed thereon where it extends into said plastic tube handle;

(b) the pitch diameter of said threads being at least as great as the inside diameter of said tube.

10. The improvement in a plastic traffic barricade of claim 9 further characterized in that:

(a) said pins are each threaded into a corresponding end of said plastic tube.

11. The improvement in a plastic traffic barricade of claim 10 further characterized in that:

(a) said plastic tube has a wall thickness of at least three-sixteenths of an inch.

* * * * *